United States Patent [19]

Vernachio

[11] Patent Number: 4,854,901

[45] Date of Patent: Aug. 8, 1989

[54] SIDE TERMINAL BATTERY CHARGING APPARATUS

[76] Inventor: Mark D. Vernachio, 347 Delaware Ave., Lansdale, Pa. 19446

[21] Appl. No.: 250,641

[22] Filed: Sep. 29, 1988

[51] Int. Cl.[4] ..... H01D 4/30

[52] U.S. Cl. ..... 439/755; 439/759

[58] Field of Search ..... 439/755, 759

[56] References Cited

U.S. PATENT DOCUMENTS

| | | | |
|---|---|---|---|
| 3,992,075 | 11/1976 | Cannaroa | 439/755 |
| 4,345,807 | 8/1982 | Shekel et al. | 339/31 B |
| 4,449,772 | 5/1984 | Johnson, III | 339/29 B |
| 4,453,791 | 6/1984 | Ledbetter | 339/29 B |
| 4,620,767 | 11/1986 | Woolf | 339/255 P |
| 4,636,025 | 1/1987 | Norris | 439/755 |

*Primary Examiner*—P. Austin Bradley

*Attorney, Agent, or Firm*—Henderson & Sturm

[57] ABSTRACT

A battery terminal connector apparatus (10) for batteries (100) having post (101) and/or recessed aperture (103) terminals; wherein, the battery terminal connector apparatus (10) includes a conventional spring biased pair of pivoted jaw members (13) having at least one post member (15) that is dimensioned to be received in a recessed aperture terminal (103).

6 Claims, 1 Drawing Sheet

FIG. 1.
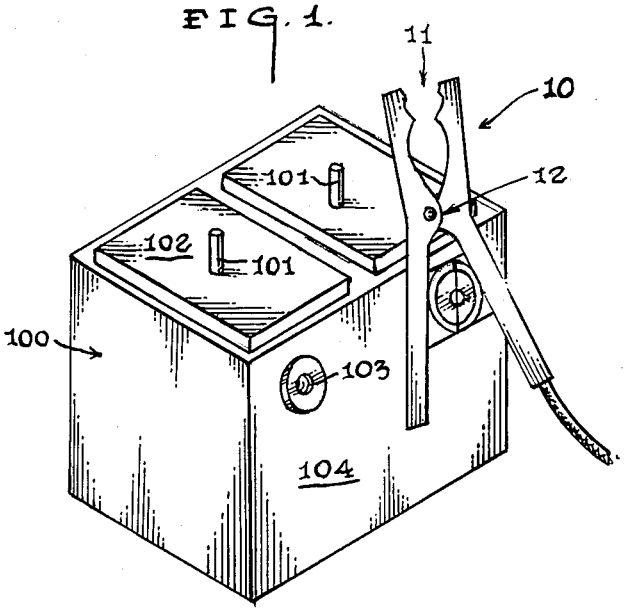
FIG. 2.
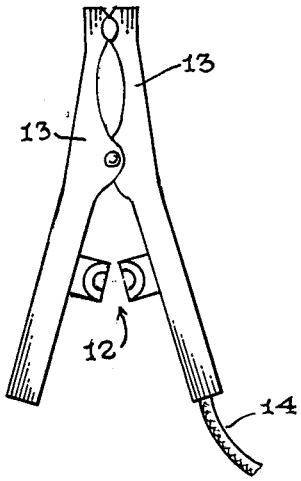
FIG. 4.
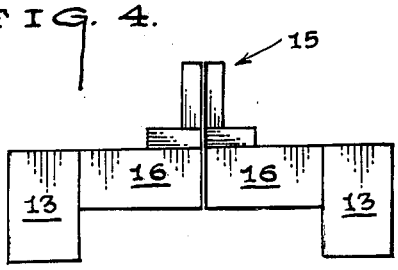
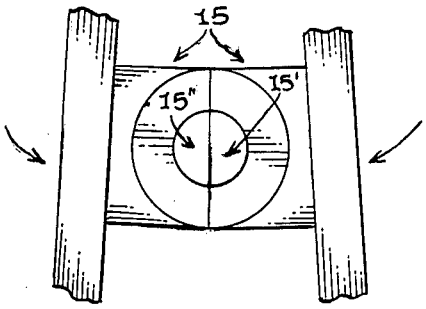
FIG. 3.
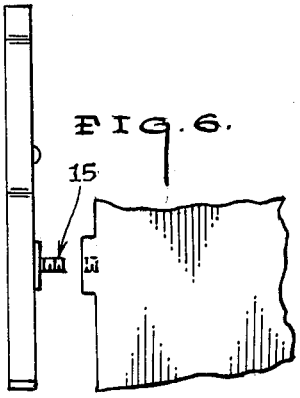
FIG. 5.
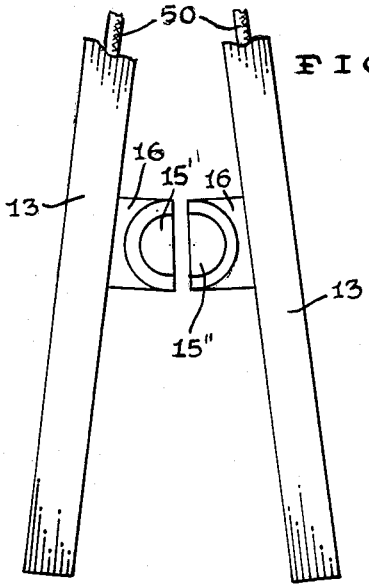
FIG. 6.

SIDE TERMINAL BATTERY CHARGING APPARATUS

TECHNICAL FIELD

The present invention relates to battery cables in general and more specifically to a battery cable apparatus that is adapted to cooperate with both post and side terminals on a battery.

BACKGROUND OF THE INVENTION

As can be seen by reference to the following U.S. Pat. Nos. 4,345,807; 4,453,791; 4,449,772; and 4,620,767 the prior art is replete with myriad and diverse connectors for battery terminals.

While all of the aforementioned prior art constructions are adequate for the general purpose for which they were designed, most of these constructions are not suitable for use with both the post type and the recessed side type of battery terminals. In addition, in those isolated instances wherein the terminal connector is supposedly designed to accommodate both types of battery terminals; the side terminals must be equipped with adaptor elements that project outwardly from the battery casing, so as to provide an electrical contact surface that can be gripped by the jaws of the cable connectors.

As a consequence of the foregoing situation there has existed a long standing need among users of both types of battery terminals for a dual purpose cable connector apparatus that is adapted to engage both a post type and a recessed side type of battery terminals; without the need for special adaptors that must be temporarily or even permanently installed in the recessed side terminals on certain batteries.

SUMMARY OF THE INVENTION

Briefly stated, the present invention comprises a dual function battery cable apparatus that is equipped with jaws that will grasp the post terminals on certain batteries while also possessing at least one outwardly projecting post member that is adapted to be received in the recessed side terminals on other batteries.

In addition, the battery cable apparatus of this invention further contemplates the utilization of the spring biased jaws in conjunction with a plurality of cooperating outwardly projecting post members; whereby, the spring biasing will enhance the frictional engagement of the cooperating post members with the interior surfaces of the recessed side terminals to provide a positive electrical connection between the battery terminal and the cables.

The battery cable apparatus further comprises a pair of spring loaded conductive jaw members connected to a covered cable member; wherein at least one of the jaw members is provided with an outwardly projecting post member that is dimensioned to be received in a recessed side terminal of a battery.

In the preferred embodiment of this invention, each of the jaw members will be provided with opposed outwardly projecting post members that cooperate with one another when the jaw members are disposed in an open configuration; whereby, the post members are positioned in close proximity to one another and are both adapted to be received in the recessed side terminal of a battery.

It should also be noted that the apparatus that forms the basis of this invention may be installed on a standard battery cable clamp; and, this apparatus may be employed for the purpose of both charging and checking the charge level on diverse battery constructions.

BRIEF DESCRIPTION OF THE DRAWINGS

These and other objects, advantages, and novel features of the invention will become apparent from the detailed description of the best mode for carrying out the preferred embodiment of the invention which follows; particularly when considered in conjunction with the accompanying drawings, wherein:

FIG. 1 is a perspective view of the battery cable connector apparatus installed on a battery;

FIG. 2 is an isolated front plan view of the connector apparatus;

FIG. 3 is an enlarged top plan view of the apparatus;

FIG. 4 is an enlarged detail view of the post members of the apparatus in their tensioned mode;

FIG. 5 is an enlarged detail view of the post members in their relaxed mode; and, FIG. 6 is a side plan view of the apparatus prior to insertion of the post members into the recessed side terminal of a battery.

BEST MODE FOR CARRYING OUT THE INVENTION

As can be seen by reference to the drawings and in particular by reference to FIG. 1, the battery terminal connector apparatus that forms the basis of the present invention is designated generally by the reference numeral (10). The connector apparatus (10) comprises in general: a jaw unit (11) and a side terminal unit (12). These units will now be described in seriatim fashion.

Prior to embarking on a detailed description of the connector apparatus (10), it would first be advisable to discuss the environment in which this apparatus (10) is to be used. Still referring to FIG. 1, it can be seen that the battery terminal connector apparatus (10) is designed to be used in conjunction with a battery (100) having either post terminals (101) disposed on the top (102) of the battery (100) or recessed aperture terminals (103) formed in one of the sides (104) of the battery (100).

Turning now to FIG. 2, it can be seen that the jaw unit (11) comprises a pair of conventional spring biased pivoted jaw members (13) connected to an insulated cable member (14); whereby electrical current may flow thru the cable member (14) into or out of the battery (100) in a well recognized fashion when the jaw members (13) engage the post terminals (101) of the battery (101).

As can best be seen by reference to FIGS. 3 thru 6, the side terminal unit (12) comprises at least one post member (15) that is operatively attached to at least one of the jaw members (13); wherein the at least one post member (15) is dimensioned to be received within and engage at least a portion of one of the recessed aperture terminals (103) of the battery (100).

In the preferred embodiment of the invention illustrated in the drawings, the side terminal unit (12) comprises a pair of post members (15')(15") each having a semicircular end section; wherein each of the post members (15')(15") project outwardly from arm elements (16) which are attached respectively to each of the jaw members (13). When both of the post members (15')(15") are brought into engagement with one another as depicted in FIGS. 3, 4, and 5, the post members (15')(15") will form an elongated cylindrical post element (15) that is dimensioned to be received within and engage the interior walls of the recessed aperture terminal (103) of the battery (100).

As shown in FIGS. 2 and 5, the normal closed position of the jaw members (13) is a result of the spring biasing effect of the conventional spring member (50) found on most battery cable connector arrangements. As a consequence of the spring biasing effect, once the post members (15')(15") are brought together in the configuration shown in FIGS. 3 and 4, the spring members (50) will tend to urge the post members (15')(15") apart, thereby enhancing the frictional engagement of the outer periphery of the post members (15')(15") with the inner periphery of the aperture terminal (103).

Having thereby described the subject matter of this invention it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A battery terminal connector apparatus for diverse batteries equipped with post and/or recessed aperture terminals wherein the apparatus comprises:

a pair of spring biased pivoted jaw members wherein one of the jaw members is operatively attached to an insulated electrical cable; and, a side terminal unit comprising at least one post member operatively attached to one of said jaw members; wherein, said at least one post member is dimensioned to be received in and engage a portion of the internal periphery of a recessed aperture terminal.

2. The apparatus as in claim 1 wherein said side terminal unit comprises:

a pair of post members wherein each of the post members is operatively attached to one of the jaw members.

3. The apparatus as in claim 2 wherein the operative attachment between each post member and each jaw member comprises an arm element.

4. The apparatus as in claim 3 wherein each arm element is connected to a respective jaw member and each post member is attached to and projects outwardly from one of the arm elements.

5. The apparatus as in claim 2 wherein the post members are adapted to be brought into close engagement with one another and dimensioned to be received in the interior of a recessed aperture terminal.

6. The apparatus as in claim 5 wherein each post member has a semicircular end configuration.

* * * * *